United States Patent [19]

Atchisson

[11] 4,299,343

[45] Nov. 10, 1981

[54] CARBINE SLING AND POUCH

[76] Inventor: Maxwell G. Atchisson, 6695 Ridgemoore Dr., Doraville, Ga. 30360

[21] Appl. No.: 201,495

[22] Filed: Oct. 28, 1980

[51] Int. Cl.[3] ..... F41C 29/00

[52] U.S. Cl. ..... 224/149; 224/150; 224/913

[58] Field of Search ..... 224/205, 149, 150, 203, 224/239, 257, 908, 913

[56] References Cited

U.S. PATENT DOCUMENTS 1,332,088 2/1920 Wagner ..... 224/150

2,647,667 8/1953 Brown et al. ..... 224/913 X 2,915,233 12/1959 Moomaw ..... 224/149

*Primary Examiner*—Steven M. Pollard

*Attorney, Agent, or Firm*—Jones, Thomas & Askew

[57] ABSTRACT

A sling and pouch assembly for attachment to a carbine, without requiring existing sling swivels and without modifying the carbine. The sling assembly includes a front swivel having a hook which fits beneath the existing barrel band of the carbine. The rear swivel is attached to one side of a cuff which fits around the stock adjacent the butt plate. The cuff assembly includes one or more pouches for storing ammunition or the like. The cuff assembly has a skid-resistant inner surface for retention on the stock of the carbine.

8 Claims, 6 Drawing Figures

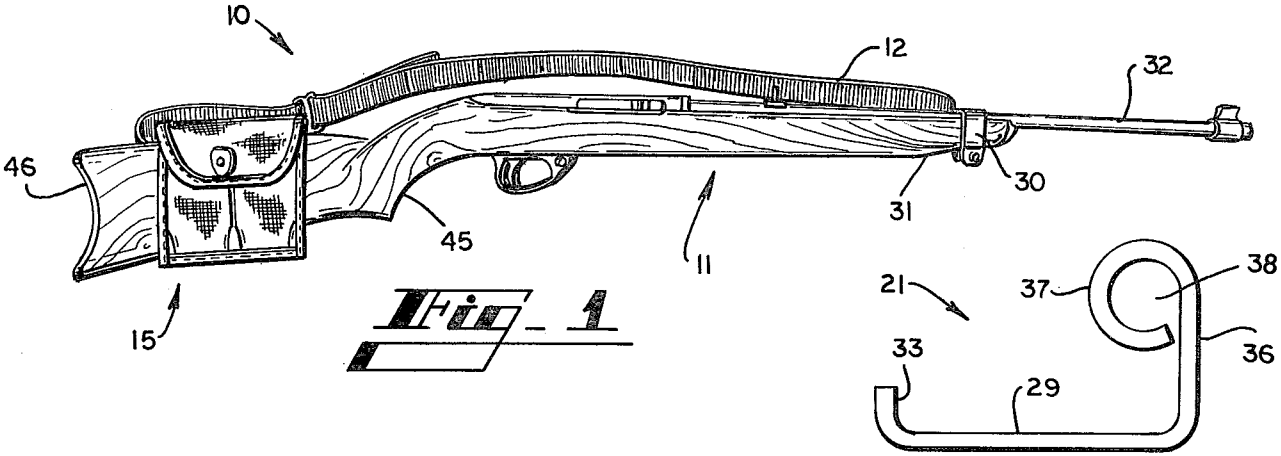
Fig. 1
Fig. 6
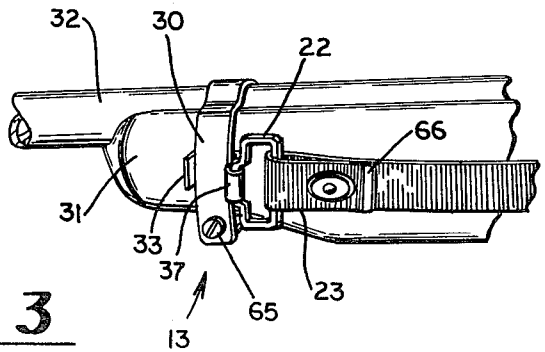
Fig. 3
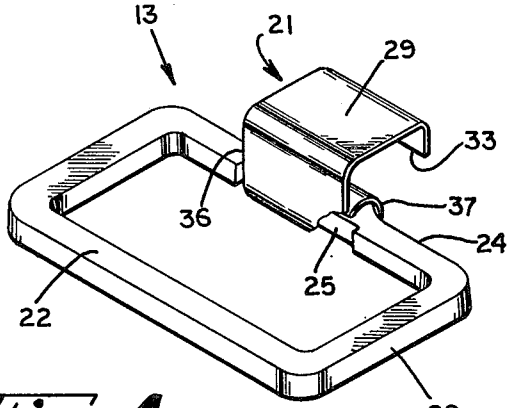
Fig. 4

CARBINE SLING AND POUCH

BACKGROUND OF THE INVENTION

This invention relates in general to slings for carrying rifles, and relates in particular to an accessory sling and pouch for installing on a carbine without altering the gun.

The use of a sling as an aid for carrying firearms such as rifles or the like is old and well known. Rifle slings generally comprise a strap attached to the front and the rear of the rifle stock by means of swivel attachments or the like, allowing the ends of the sling to turn relative to the rifle. The sling is usually equipped with a budkle or similar arrangement permitting the overall length of the sling strap to be adjusted, so as to accommodate the build and personal preference of the individual carrying a sling rifle.

Some rifles come factory-equipped with swivels or other attachments permitting a sling to be easily installed. One example is the well-known U.S. military carbine caliber .30 M1, popularly known as the M1 carbine. The M1 carbine is supplied with a front swivel attached near the front end of the stock, and a conventional sling can easily be attached to the front swivel. The back end of the sling is looped around the conventional oiler which fits in a vertical cutout in the stock of the M1 carbine, forward of the buttplate. Thus, a sling is quickly and easily attached to existing fittings on a rifle such as the M1 carbine.

Installing a rifle sling presents problems, however, where the rifle lacks swivels or other fittings for connecting the sling. Conventionally, the necessary swivels are added by drilling mounting holes in the stock of the gun. Drilling the stock to attach the swivel fittings must be carefully done to insure proper alignment and to avoid splitting the wooden stock, and this task is best performed by a competent gunsmith. This work is expensive, and the added swivel attachments may not later be removed without leaving remaining holes which disfigure the stock. Alternatively, the front swivel may be clamped to the barrel immediately in front of the stock. Barrel clamps generally present an awkward and unpleasing appearance, and may also damage the surface finish of the barrel.

Accordingly, it is an object of the present invention to provide an improved sling for attachment to firearms.

It is another object of the present invention to provide an accessory sling which is easily attachable to a rifle such as a carbine or the like, without altering the rifle.

It is still another object of the present invention to provide an improved sling which incorporates a pouch for carrying spare ammunition or other articles.

SUMMARY OF INVENTION

Stated in general terms, the present invention is a sling assembly comprising means to hook beneath the existing barrel band at the front of a carbine, and having a cuff which fits snugly around the stock adjacent the butt end. Separate sling swivels are attached to the hook means and to the cuff, for attaching a sling extending therebetween. A pouch for storing ammunition or other articles may also be attached to the cuff.

BRIEF DESCRIPTION OF DRAWINGS

FIG. 1 is a pictorial view showing a conventional Ruger 10/22 carbine fitted with a sling and pouch assembly according to the preferred embodiment of the present invention.

FIG. 3 is another fragmentary elevation view taken from the left side of the carbine, showing details of the front sling swivel and hook.

FIG. 4 is a detailed pictorial view showing the sling swivel and barrel band hook assembly, with the hook shown partially broken away.

FIG. 6 is a plan view of the barrel band hook.

DESCRIPTION OF PREFERRED EMBODIMENT

Figure 2:
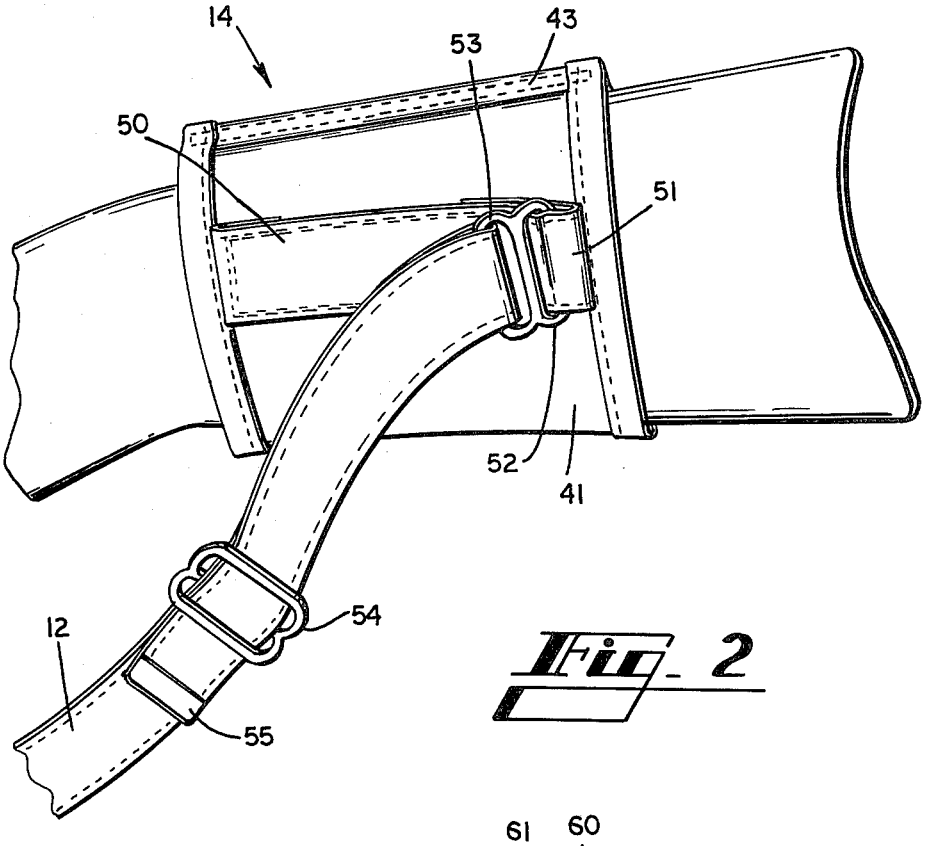
FIG. 2 is a fragmentary elevation view of the sling and pouch assembly shown in FIG. 1, taken from the left side of the carbine and showing details of the cuff.

FIG. 1 shows a sling and pouch assembly 10 according to the disclosed embodiment of the invention, installed on a conventional unmodified Ruger carbine. Although the disclosed embodiment of sling assembly 10 is shown and described with respect to a Ruger carbine, and specifically either a 10/22 or a .44 model Ruger carbine, it should be understood that a specific carbine is shown only for illustrative purposes, and that the present invention may readily be utilized in connection with other rifles.

The sling assembly 10 is made of a sling 12, a front swivel 13 (FIGS. 3 and 4), and a cuff 14 (FIGS. 2 and 5) including the attached pouch 15 shown in FIG. 1. The nature and function of each component of the sling assembly 10 is described below.

The front swivel assembly 13 includes the sling swivel 20 and the barrel band hook 21 which is permanently attached to the sling swivel. The sling swivel 20 is a solid matallic rectangular member ring having a first elongated arm 22 about which the forward end 23 of the sling 12 is looped, and having a second elongated arm 24 to which the hook 21 is attached. Arm 24 of the sling swivel 20 has a laterally offset portion 25 medially located on the second arm, so as to define the longitudinal location of the hook 21 on the sling swivel.

The barrel band hook 21, best seen in FIGS. 4 and 6, includes a flat band-receiving surface 29 whose length is substantially the same as the width of the conventional barrel band 30 (FIGS. 1 and 3) which secures the front end of the carbine stock 31 to the barrel 32. The barrel band hook 21 has an upturned flange 33 at one end of the band receiving surface 29, the flange being slightly longer than the thickness of the barrel band 30.

The hook 21 has an outwardly-extending portion 36 at the end of surface 29 opposite the flange 33, and the outer end of the portion 36 is turned inwardly as at 37 to define the hollow opening 38, which loosely fits around the offset portion 25 of the sling swivel 13 as shown in FIG. 4. The lateral offset of portion 25 prevents the hook 21 from sliding along the arm 24 of the sling swivel 20, although the hook 21 can rotate about the arm.

Figure 5:
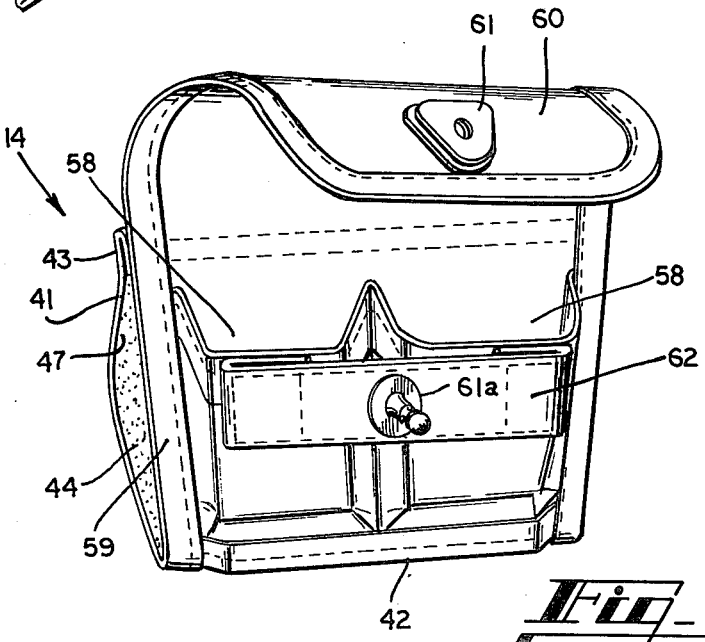
FIG. 5 is a pictorial view of the cuff and pouch.

Turning next to the cuff assembly 14 as best seen in FIGS. 2 and 5, the cuff assembly includes a band 41 preferably made of a woven fabric such as canvas or the like, folded along a lower side 42 and then laid back against itself and secured by stitching along the line 43, thereby defining a hollow cuff opening 44. The cuff opening 44 should be of the proper size and shape to be a snug fit about the rear end of the stock 31 just past the pistol grip 45 (FIG. 1), spaced a short distance in front of the butt plate 46. The inner surface of the fabric defining the cuff opening 44 is preferably provided with a high-friction nonskid surface 47 which tends to resist sliding movement of the cuff assembly 14 along the stock 31. In an actual embodiment of the present invention utilizing a cuff member 14 fabricated from woven fabric, the nonskid surface 47 is provided by impregnating the inner surface of the cuff fabric with rubber cement, which is allowed to dry before the cuff assembly is installed on the carbine 11 as described below. Other kinds of nonskid surfaces may be substituted.

A longitudinally-extending fabric band 50 (FIG. 2) is attached to the left outer surface of the cuff-defining band 41. A loop 51 is formed at the rear of the band 50 and stitched in place, and one ring of a double-ring 52 is permanently retained in the loop 51 at the end of the band 50. The other ring 53 of the double-ring 52 forms the rear swivel for the sling 12. As seen in FIG. 2, the sling 12 includes a conventional buckle 54 through which the free end 55 of the sling is connected, so that the sling can be disconnected for attachment or removal of the rear swivel, or for adjusting the overall length of the sling.

Returning to FIGS. 1 and 5, the right side of the cuff assembly 14 includes a pair of pouches 58 formed by a separate fabric panel stitched to the right side 59 of the cuff band 41. The pouches 58 preferably are closeably by means of a cover flap 60 which may conveniently be formed as an extension of the cuff band 41 beyond the top stitching 43. The flap 60 may be secured to close the pouches 58 by means of a conventional snap fastener 61. The mating element **61*a* of the snap fastener is mounted on a supporting band 62 which bridges the gap between the two separate pouches 58**.

The disclosed embodiment has two pouches 58 of substantially the same size, although the number and size of pouches is obviously a matter of choice. In one embodiment of the present sling assembly designed for a Ruger 10/22 .22 rimfire carbine, each pouch 58 is sized to accommodate interchangeably a 50-round box of .22 ammunition or a standard Ruger 10-round box magazine. This same embodiment of the present sling assembly also fits a Ruger .44 magnum carbine, and the aforementioned pouches 58 together hold fourteen rounds of .44 magnum cartridges.

The present sling assembly is installed on the carbine 11 in the following manner. The existing barrel band screw 65 (FIG. 3) of the carbine 11 is loosened, and the barrel band 30 is removed from the carbine. The stock screw (not shown) of the carbine is also removed, allowing the barrel 32 and connected action to be moved from the stock 31. The entire cuff assembly 14 is now slipped over the front end of the stock, and moved past the pistol grip 45 until the cuff assembly is a snug fit around the stock just past the pistol grip. The action and stock of the carbine 11 should now be reassembled.

The barrel band 32 is now repositioned about the barrel 32 and the front end of the stock 31, making sure that the surface 29 of the barrel band hook 21 is retained beneath the barrel band on the left side of the stock as shown in FIG. 3. The barrel band screw 65 is now tightened.

The sling 12 is attached by placing the front snap end 66 of the sling through the front sling swivel 20 and then securing the front snap end in place around the front sling swivel. The rear end of the sling is attached to the rear swivel ring 52 of the cuff assembly as previously described, and the position of the slide 54 is adjusted to give the sling the desired length.

The sling assembly is now completely installed on the carbine, without modifying or altering the carbine in any way. The sling assembly can be removed by reversing the foregoing steps, leaving no unused swivels or other hardware remaining on the carbine. Moreover, the foregoing attachment and removal procedures are relatively simple, requiring only a screwdriver and no gunsmithing skills, and may be accomplished by anyone having a modicum of mechanical ability.

It should be understood that the foregoing relates only to a preferred embodiment of the present invention, and that numerous changes and modifications may be made therein without departing from the spirit or scope of the invention as defined in the following claims.

I claim:

1. A sling assembly for attachment to a carbine having a barrel; a stock with a forward end adjacent the barrel of the carbine, and a back end; and an existing barrel band securing the barrel to the forward end of the forward end of the stock, said assembly comprising in combination:

hook means separate from said barrel band and having a substantially flat portion fitting between said barrel band and said stock, so as to be removably clamped to the carbine without requiring modification to the stock;

means attached to said hook means for providing a sling front swivel;

means defining a cuff separate from and fitting snugly around the stock adjacent the butt end;

means attached to the exterior of said cuff for providing a sling rear swivel; and sling means removably attached to said sling front and rear swivels and extending therebetween.

2. A sling assembly as in claim 1, wherein:

said hook means and said sling rear swivel means both are disposed on one side of the carbine, so that said sling means is attached to the carbine on said one side; and further comprising means defining a pouch carried by said cuff means on the other side of said carbine, said pouch having at least one article receiving recess.

3. A sling assembly as in claim 2, wherein:

said cuff comprises a unitary tubular member of flexible material having an inner surface in confronting contact with the surface of said stock; and said inner surface being operative to resist sliding movement along said stock, so that said cuff tends to remain in place around said stock without being fastened thereto.

4. A sling assembly as in claim 1, further comprising means on the stock-contacting surface of said cuff providing a skid-resistant frictional engagement with said stock.

5. A sling assembly as in claim 1, wherein:

said cuff means comprises a tubular flexible member of woven material, and has an inner surface configured for snug confronting contact with the surface of said stock at a predetermined location on the stock; and means on said fabric inner surface providing a substantially skid-resistant frictional engagement with said stock, so that said cuff tends to remain in place on the stock without being fastened thereto.

6. A sling assembly as in claim 1, wherein:

said hook means comprises a unitary member having a first portion defining said flat portion;

a second portion joining said first portion at one end thereof and extending outwardly therefrom to terminate in a hollow member; and a third portion joining said first portion at the other end thereof and extending outwardly therefrom to engage said barrel band, so as to retain said hook means in place between the barrel band and said stock.

7. A sling assembly as in claim 6, wherein:

said means attached to said hook means comprises a ring having a first portion received in said hollow member of said hook means, and a second portion for receiving an end of said sling means; and said ring first portion is offset sufficiently to be retained in fixed yet swivelable relation with respect to said hollow member, so as to retain said sling front swivel in predetermined relation to said sling means.

8. A sling assembly as in either of claims 6 or 7, wherein:

said cuff means comprises a tubular flexible member of woven material and having an inner surface configured for snug confronting contact with a predetermined location on said stock;

means on said fabric inner surface providing a substantial skid-resistant frictional engagement with said stock, so that said cuff tends to remain in place on the stock; and means defining a pouch carried by said cuff means, said pouch having at least one article receiving recess.

* * * * *